US011342110B2

(12) United States Patent
Oh et al.

(10) Patent No.: US 11,342,110 B2
(45) Date of Patent: May 24, 2022

(54) INDUCTOR

(71) Applicant: SAMSUNG ELECTRO-MECHANICS CO., LTD., Suwon-si (KR)

(72) Inventors: Seon Woo Oh, Suwon-si (KR); Hyung Jin Jeon, Suwon-si (KR); Jung Wook Seo, Suwon-si (KR); Young Seuck Yoo, Suwon-si (KR); Byoung Hwa Lee, Suwon-si (KR); Kwang Sun Choi, Suwon-si (KR); Kun Ho Koo, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 820 days.

(21) Appl. No.: 16/031,216

(22) Filed: Jul. 10, 2018

(65) Prior Publication Data

US 2019/0122810 A1 Apr. 25, 2019

(30) Foreign Application Priority Data

Oct. 25, 2017 (KR) ..... 10-2017-0139213
Dec. 7, 2017 (KR) ..... 10-2017-0167356

(51) Int. Cl.
*H01F 27/29* (2006.01)
*H01F 27/06* (2006.01)
(Continued)

(52) U.S. Cl.
CPC ..... *H01F 27/292* (2013.01); *H01F 17/0013* (2013.01); *H01F 17/04* (2013.01);
(Continued)

(58) Field of Classification Search
CPC ..... H01F 27/292; H01F 27/327; H01F 27/06
(Continued)

(56) References Cited

U.S. PATENT DOCUMENTS 6,165,379 A * 12/2000 Kono ..... C03C 8/18 252/62.59
6,373,368 B1 * 4/2002 Shikama ..... H01F 27/027 336/200
(Continued)

FOREIGN PATENT DOCUMENTS

CN 103199266 A 7/2013
GN 105575621 A 5/2016
(Continued)

OTHER PUBLICATIONS

The Second Office Action issued in corresponding Chinese Patent Application No. 201811210084.6 dated Mar. 5, 2021, with English translation.
(Continued)

*Primary Examiner* — Elvin G Enad
*Assistant Examiner* — Joselito S. Baisa
(74) *Attorney, Agent, or Firm* — Morgan, Lewis & Bockius LLP

(57) ABSTRACT

An inductor includes a body including an internal coil having first and second end portions and an encapsulant encapsulating the internal coil and containing magnetic particles. First and second external electrodes are on external surfaces of the body and electrically connected to the internal coil. A first metal expansion portion encloses the first end portion while coming into direct contact with the first end portion of the internal coil, and may be between the body and the first external electrode. A second metal expansion portion encloses the second end portion while coming into direct contact with the second end portion of the internal coil, and may be between the body and the second external electrode.

24 Claims, 3 Drawing Sheets

I-I'

(51) Int. Cl.
*H01F 27/32* (2006.01)
*H01F 17/00* (2006.01)
*H01F 17/04* (2006.01)
*H01F 1/37* (2006.01)

(52) U.S. Cl.
CPC ..... *H01F 27/06* (2013.01); *H01F 27/327* (2013.01); *H01F 1/37* (2013.01); *H01F 2017/048* (2013.01)

(58) Field of Classification Search
USPC ..... 336/192
See application file for complete search history.

(56) References Cited

U.S. PATENT DOCUMENTS

| | | | | |
|---|---|---|---|---|
| 9,378,884 | B2 * | 6/2016 | Kim | H01F 27/00 |
| 9,437,365 | B2 * | 9/2016 | Saito | H01G 4/232 |
| 9,514,884 | B2 * | 12/2016 | Lee | H01G 4/005 |
| 9,524,817 | B2 * | 12/2016 | Kim | H01F 17/0033 |
| 9,583,251 | B2 * | 2/2017 | Moon | H01F 27/292 |
| 10,062,514 | B2 * | 8/2018 | Katsuta | H01G 4/232 |
| 10,079,108 | B2 * | 9/2018 | Hatanaka | H01G 4/306 |
| 10,504,653 | B1 * | 12/2019 | Park | H01G 4/1227 |
| 10,658,117 | B2 * | 5/2020 | Kim | H01G 4/30 |
| 10,854,383 | B2 * | 12/2020 | Choi | H01F 17/0013 |
| 2009/0052114 | A1 * | 2/2009 | Motoki | H01G 4/2325 361/306.3 |
| 2009/0269598 | A1 | 10/2009 | Ohashi et al. | |
| 2014/0321025 | A1 * | 10/2014 | Saito | C25D 5/505 361/305 |
| 2015/0022305 | A1 | 1/2015 | Lee et al. | |
| 2015/0136463 | A1 | 5/2015 | Lee et al. | |
| 2015/0371752 | A1 | 12/2015 | Park et al. | |
| 2016/0086714 | A1 | 3/2016 | Moon et al. | |
| 2016/0126004 | A1 | 5/2016 | Yang et al. | |
| 2016/0126006 | A1 | 5/2016 | Ahn et al. | |
| 2016/0164483 | A1 | 6/2016 | Park et al. | |
| 2016/0217920 | A1 | 7/2016 | Choi et al. | |
| 2016/0268036 | A1 | 9/2016 | Nakamura et al. | |
| 2017/0301468 | A1 | 10/2017 | Kim et al. | |
| 2017/0330689 | A1 * | 11/2017 | Hatanaka | H01G 4/30 |
| 2018/0286594 | A1 * | 10/2018 | Kim | H01G 4/12 |
| 2019/0371526 | A1 * | 12/2019 | Ubukata | H01G 4/2325 |

FOREIGN PATENT DOCUMENTS

| | | | | |
|---|---|---|---|---|
| JP | H11-350190 | A | 12/1999 | |
| JP | 2000-182883 | A | 6/2000 | |
| JP | 2002-124533 | A | 4/2002 | |
| JP | 2009-283453 | A | 12/2009 | |
| JP | 2010-10671 | A | 1/2010 | |
| JP | 2010-186909 | A | 8/2010 | |
| JP | 2011-143442 | A | 7/2011 | |
| JP | 2013-069713 | A | 4/2013 | |
| JP | 2015-023275 | A | 2/2015 | |
| JP | 2015-26839 | A | 2/2015 | |
| JP | 2015-47615 | A | 3/2015 | |
| JP | 2016-009858 | A | 1/2016 | |
| JP | 2016-92404 | A | 5/2016 | |
| JP | 2016-111349 | A | 6/2016 | |
| JP | 2016-139789 | A | 8/2016 | |
| JP | 2016-171115 | A | 9/2016 | |
| JP | 2017-168873 | A | 9/2017 | |
| JP | 2017-191929 | A | 10/2017 | |
| JP | 2017191929 | A * | 10/2017 | H01G 4/2325 |
| KR | 10-2010-0110891 | A | 10/2010 | |
| KR | 10-2014-0032212 | A | 3/2014 | |
| KR | 10-1474168 | B1 | 12/2014 | |
| KR | 10-1580411 | B1 | 12/2015 | |

OTHER PUBLICATIONS

Office Action issued in corresponding Japanese Application No. 2018-129583, dated Apr. 2, 2019.
Office Action issued in corresponding Japanese Patent Application No. 2019-214058 dated Sep. 8, 2020, with English translation.
Japanese Office Action dated Dec. 4, 2018 issued in Japanese Patent Application No. 2018-129683 (with English translation).
Development of Lead-Free Tin-Silver-Copper (Sn—Ag—Cu) Solder, Magazine Fujitsu (and its English Abstract) No. 5, vol. 51, Sep. 1, 2000, pp. 341-344.
Office Action issued in corresponding Chinese Patent Application No. 201811210084.6 dated Sep. 10, 2020, with English translation.

* cited by examiner

I-I'

INDUCTOR

CROSS-REFERENCE TO RELATED APPLICATION(S)

This application claims benefit of priority to Korean Patent Application Nos. 10-2017-0139213 filed on Oct. 25, 2017 and 10-2017-0167356 filed on Dec. 7, 2017 in the Korean Intellectual Property Office, the disclosure of which is incorporated herein by reference in its entirety.

BACKGROUND

1. Field

The present disclosure relates to an inductor, and more particularly, to a power inductor.

2. Description of Related Art

In accordance with the recent trend for high performance and a larger screen sizes in electronic devices, portable electronic devices such as a smartphones require high reliability and miniaturized internal components. Reliability of power inductors can be improved by increasing break down voltage (BDV) through magnetic coating, increasing body strength system-in-package (SiP) applications, and the like. But when a power inductor is mounted around a power management integrated circuit (PMIC), an external electrode may become detached due to stress caused by thermal contraction and expansion, which may decrease the reliability of the power inductor.

SUMMARY

As aspect of the present disclosure may provide an inductor in which reliability is secured by increasing contact properties between an internal coil and an external electrode.

According to an aspect of the present disclosure, an inductor may include a body including an internal coil having first and second end portions and an encapsulant encapsulating the internal coil and containing magnetic particles. First and second external electrodes may be on external surfaces of the body and electrically connected to the internal coil.

A first metal expansion portion may enclose the first end portion and be in direct contact with the first end portion of the internal coil. The first metal expansion portion may be between the body and the first external electrode. A second metal expansion portion may enclose the second end portion and come into direct contact with the second end portion of the internal coil. The second metal expansion portion may be between the body and the second external electrode.

First and second connection layers composed of a plurality of layers may be respectively interposed between the first and second metal expansion portions and the first and second external electrodes. Each of the plurality of layers may contain an intermetallic compound.

BRIEF DESCRIPTION OF DRAWINGS

The above and other aspects, features, and advantages of the present disclosure will be more clearly understood from the following detailed description taken in conjunction with the accompanying drawings, in which.

DETAILED DESCRIPTION

Hereinafter, exemplary embodiments of the present disclosure will be described in detail with reference to the accompanying drawings.

An inductor according to an exemplary embodiment in the present disclosure will be described, but is not necessarily limited thereto.

Figure 1:
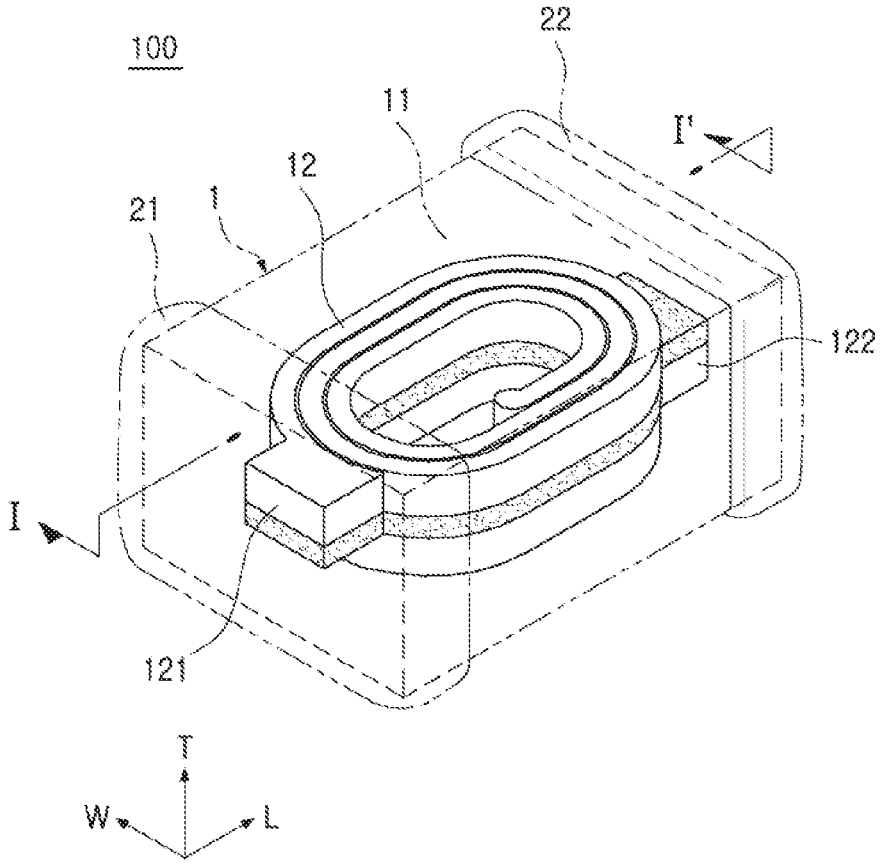
FIG. 1 is a perspective view of an inductor according to an exemplary embodiment in the present disclosure.
Figure 2:
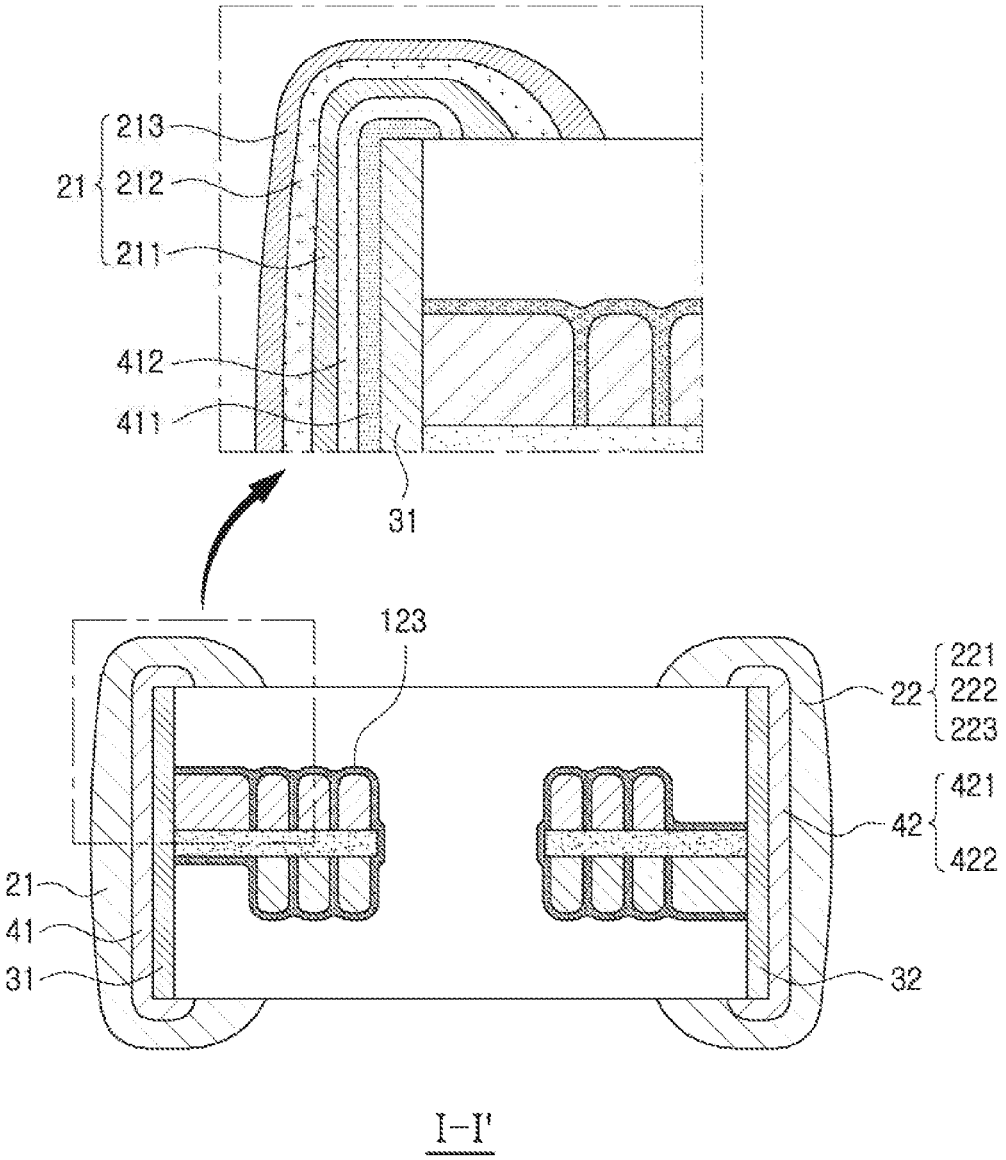
FIG. 2 is a cross-sectional view taken along line I-I' of FIG. 1.

FIG. 1 is a perspective view of an inductor 100 according to the present disclosure. FIG. 2 is a cross-sectional view taken along line I-I' of FIG. 1.

Referring to FIGS. 1 and 2, the inductor 100 may include a body 1 and first and second external electrodes 21 and 22 on external surfaces of the body.

The body 1 may form an exterior of the inductor. The body 1 may have upper and lower surfaces opposing each other in a thickness direction (T), first and second end surfaces opposing each other in a length direction (L), and first and second side surfaces opposing each other in a width direction (W). The body 1 may have a substantially hexahedral shape.

The body 1 may include an encapsulant 11 containing magnetic particles. The encapsulant 11 may be formed of a magnetic particle-resin composition in a state in which the magnetic particles are dispersed in a resin. For example, the encapsulant 11 maybe formed by filling ferrite or a metal based soft magnetic material. The ferrite may include ferrite known in the art such as, for example, Mn—Zn based ferrite, Ni—Zn based ferrite, Ni—Zn—Cu based ferrite, Mn—Mg based ferrite, Ba based ferrite, Li based ferrite, or the like. The metal based soft magnetic material may be an alloy containing at least one selected from the group consisting of Fe, Si, Cr, Al, and Ni. For example, the metal based soft magnetic material may contain Fe—Si—B—Cr based amorphous metal particles, but is not limited thereto. The metal based soft magnetic material may have a particle size of 0.1 μm or more to 20 μm or less. The ferrite or metal based soft magnetic material may be contained in a state in which the ferrite or metal based soft magnetic material is dispersed on a polymer such as an epoxy resin, polyimide, or the like, thereby forming the body.

An internal coil 12 may be embedded in the body by the encapsulant, and may include first and second end portions 121 and 122 exposed at the first and second end surfaces of the body, respectively, so that the internal coil 12 may be connected to an external component. Although the first and second end portions are illustrated as being exposed at the first and second end surfaces, respectively, the first and second end portions are not limited thereto.

The internal coil may have an entirely spiral shape. The specific method of forming the internal coil is not limited. For example, the internal coil may be formed on a substrate by a plating method. Alternatively, the internal coil may be formed by winding a metal strip prepared in advance or stacking a plurality of magnetic sheets after printing a portion of an internal coil pattern on the plurality of magnetic sheets.

The internal coil may be insulated from the magnetic material by an insulation coating layer 123 formed on an exposed surface of the internal coil. The method of forming the insulation coating layer is not particularly limited, and the material of the insulation coating layer is not particularly limited as long as it contains a material having insulation properties.

FIG. 2 illustrates the structure between the internal coil and the external electrode in more detail. A first metal expansion portion 31 may be between the first end portion of the internal coil and the first external electrode. A second metal expansion portion 32 maybe between the second end portion of the internal coil and the second external electrode. The first and second metal expansion portions may be formed of a metal material. The first and second metal expansion portions may each include Cu plating layers.

Any metal material may be used without limitation as long as it is suitable for serving to strengthen electrical connectivity between the internal coil and the external electrode and provide excellent electrical conductivity. For example, since the first and second metal expansion portions may contain substantially the same composition as that of the internal coil, the first and second metal expansion portions may contain Cu. Because the first and second metal expansion portions serve to increase the contact area between the internal coil and the external electrode, the contact area between the first metal expansion portion and the first end surface needs to be larger than the area of the portion of the first end portion of the internal coil exposed at the first end surface. Similarly, the contact area between the second metal expansion portion and the second end surface needs to be larger than the area of the portion of the second end portion of the internal coil exposed at the second end surface. The first and second metal expansion portions may be formed to enclose the portions of the first and second end portions exposed at the first and second end surfaces, respectively.

The thickness of the first and second metal expansion portions may be in a range of 1 to 20 μm in accordance with the trend toward reduction in size of the inductor. When the thickness is less than 1 μm, it may be technically difficult to maintain a shape enclosing the exposed portions of the first and second end portions at a uniform thickness. When the thickness is more than 20 μm, there is a need to excessively decrease a thickness of the external electrode in order to maintain an entire size of the inductor.

The first and second metal expansion portions 31 and 32 may be enclosed by the first and second external electrodes 21 and 22, respectively. A first connection layer 41 may be interposed between the first metal expansion portion and the first external electrode, and a second connection layer 42 may be interposed between the second metal expansion portion and the second external electrode. The first and second connection layers may be intermetallic compounds (IMCs) formed by contact between the first metal expansion portion and the first external electrode and between the second metal expansion portion and the second external electrode, respectively. The intermetallic compound may be formed by binding between metal ingredients contained in the first and second metal expansion portions and metal ingredients contained in layers disposed in the innermost portions of first and second external electrodes. The intermetallic compound may be a Cu—Sn intermetallic compound. The Cu ingredient may be derived from a copper ingredient in the first and second metal expansion portions and the Sn ingredient may be derived from a tin ingredient contained in the layers formed in the innermost portions of the first and second external electrodes. More specifically, the tin ingredient contained in the first and second external electrodes may be derived by applying an Ag—Sn based solder-epoxy based compound paste when forming the layers formed in the innermost portions of the first and second external electrodes using an Ag-epoxy containing paste. The Sn ingredient may remain depending on the ratio between the number of moles of Sn based solder added to the Ag—Sn based solder-epoxy based compound and the number of moles of Ag particles added thereto. As the remaining Sn ingredient and the copper ingredient in the first and second metal expansion portions form the intermetallic compound again, the first and second connection layers may be formed. In the Ag—Sn based solder-epoxy based compound paste, the Sn based solder may be formed of a powder represented by Sn, $Sn_{96.5}Ag_{3.0}Cu_{0.5}$, $Sn_{42}Bi_{58}$, $Sn_{72}Bi_{28}$, or the like, but is not limited thereto. The weight ratio of conductive particles having a high melting point in the paste, Ag particles and solder particles, for example, may be 55:45 or more to 70:30 or less. When the weight ratio is within the above-mentioned ratio, stable connection layers may be formed inwardly of the innermost portions of the external electrodes, respectively.

The enlarged view of part A of FIG. 2 illustrates the structures of the first and second connection layers. Each of the first and second connection layers 41 and 42 may be divided into at least two layers. Inner layers 411 and 421 close to the first and second metal expansion portions in the first and second connection layers maybe formed of a $Cu_6Sn_5$ alloy. Outer layers 412 and 422 close to the first and second external electrodes may be formed of a $Cu_3Sn$ alloy. Although the inner and outer layers are illustrated as being continuously formed along the entire first and second end surfaces of the body in FIG. 2, when controlling the molar ratio between Ag and Sn compositions in the Ag—Sn based solder-epoxy based compound in the first and second external electrodes, at least one of the inner and outer layers may be formed as a discontinuous layer.

The first and second connection layers may be enclosed by the first and second external electrodes, respectively. More specifically, the first and second connection layers may have a structure in which the first and second connection layers are enclosed by first layers 211 and 221 disposed in the innermost portions of the first and second external electrodes 21 and 22, respectively. Since the connection layers 41 and 42 are interposed between the first layers 211 and 221 and the first and second metal expansion portions, respectively, the first layers 211 and 221 may be layers formed using an Ag—Sn based solder-epoxy based paste. The first layers 211 and 221 may contain an epoxy based resin. The epoxy based resin is a thermosetting resin and those skilled in the art may select another thermosetting resin instead of the epoxy based resin to change the composition of the first layers without limitation. The structure of the first layer may include a conductive frame and a cured resin filled in the conductive frame. The conductive frame may contain an Ag—Sn based alloy. For example, the Ag—Sn based alloy constituting the conductive frame may be $Ag_3Sn$. The conductive frame may have a structure in which Ag particles or solder particles having different Sn contents from each other are irregularly dispersed.

Since the first layer includes the conductive frame having a continuously connected networking structure, the entire mechanical strength of the external electrode may be increased and the DC resistance (Rdc) of the inductor may be decreased.

The first and second external electrodes 21 and 22 may further include second layers 212 and 222 on the first layers 211 and 221 disposed in the innermost portions thereof, respectively. The second layers may preferably be Ni plating layers. The first and second external electrodes 21 and 22 may further include Sn-containing plating layers as third layers 213 and 223 on the second layers, respectively, in order to improve soldering characteristics at the time of mounting the inductor on an external board.

The following Table 1 illustrates tensile strength results of an external electrode obtained by measuring force required to separate the external electrode while pulling the external electrode outwardly after soldering a pin to both end portions of the external electrode of an inductor.

The inductor of Inventive Example 1 included metal expansion portions, connection layers, and external electrodes with an innermost layer containing a conductive frame filled with resin, according to the present disclosure. The inductor of Inventive Example 1 contained about 60 wt % of Ag in an Ag-epoxy in its external electrodes and contained copper, tin, and a plurality of resin materials such as an epoxy bisphenol A resin, polyvinyl butyral, and the like, in addition to Ag. The size of the inductor was 1.4 mm×2.0 mm×1.0 mm (width×length×thickness), and the series inductance (Ls) was 0.47 μH.

In contrast, the inductor of Comparative Example 1 differed from the inductor in Inventive Example 1 in that end portions of the internal coil came into direct contact with the external electrodes and each of the external electrodes sequentially included a Ni-containing plating layer and a Sn-containing plating layer from an innermost portion thereof. The inductor of Comparative Example 2 was differed from the inductor of Comparative Example 1 in that a metal-resin paste of Ag-epoxy was applied before forming the Ni-containing plating layer.

TABLE 1

| No. | Average of Measured Tensile Strength [kgf] | Tensile Strength Increase Rate Based on Comparative Example 1 |
|---|---|---|
| Comparative Example 1 | 2.13 | — |
| Comparative Example 2 | 3.15 | Increased by About 48% |
| Inventive Example 1 | 4.18 | Increased by About 96% |

As illustrated in Table 1, in the inductor of Inventive Example 1, tensile strength of the external electrode was nearly twice that of the inductor of Comparative Example. The inductor in Inventive Example 1 had improved tensile strength not only due to the first and second metal expansion portions between the first and second end portions of the internal coil and the first and second external electrodes, but also due to the first and second connection layers connected thereto, the skeletal structure of the conductive frame formed of an IMC compound in first layers in innermost portions of the first and second external electrodes and the cured resin filled in the skeletal structure.

Figure 3:
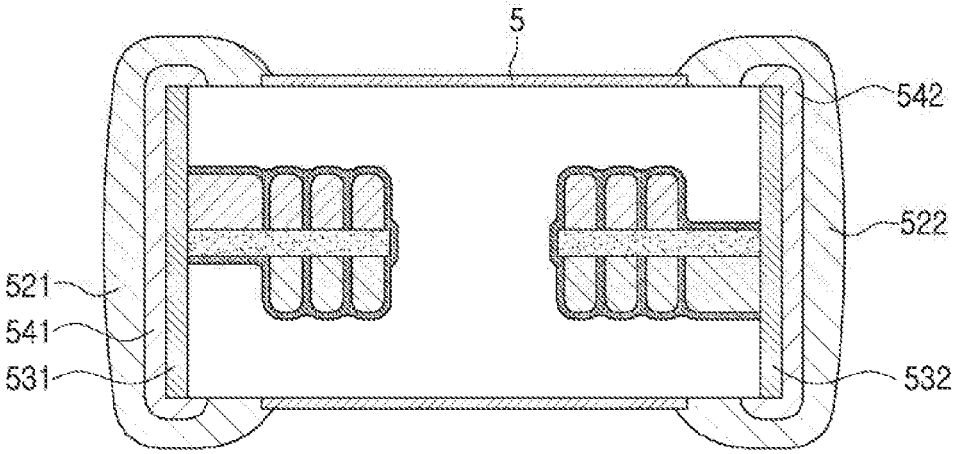
FIG. 3 is a cross-sectional view of an inductor according to a modified example of the inductor of FIGS. 1 and 2.

FIG. 3 is a cross-sectional view of an inductor 200 in which an insulating layer 5 for insulating a body is further added to the inductor 100 of FIGS. 1 and 2. The inductor of FIG. 3 includes substantially the same configurations as those in the inductor of FIGS. 1 and 2 and further includes the insulating layer 5. Accordingly, for convenience of explanation, a description of overlapping aspects is omitted, and the same components will be denoted with the reference numerals of FIGS. 1 and 2.

Referring to FIG. 3, the insulating layer 5 may be on upper and lower surfaces of the body in order to prevent plating spread of the first and second metal expansion portions on first and second end surfaces of the body. The insulating layer 5 may contain a material having insulating properties, for example, polyimide, parylene, an epoxy resin, or the like. As illustrated in FIG. 3, the first and second metal expansion portions need not extend above the upper surface of the insulating layer. However, it does not matter if the first and second metal expansion portions are extended to portions of the upper surface of the insulating layer as long as the extension is performed within an error range of an entire size of the inductor.

As set forth above, according to exemplary embodiments in the present disclosure, an inductor in which tensile strength between the internal coil and the external electrode is strengthened and of which Rdc characteristics are improved by improving the contact property between the internal coil and the external electrode may be provided.

While exemplary embodiments have been shown and described above, it will be apparent to those skilled in the art that modifications and variations could be made without departing from the scope of the present invention as defined by the appended claims.

What is claimed is:

1. An inductor comprising:

a body including an internal coil having first and second end portions and an encapsulant encapsulating the internal coil and containing magnetic particles; and first and second external electrodes on external surfaces of the body and electrically connected to the internal coil, a first metal expansion portion between the body and the first external electrode and directly in contact with the first end portion;

a second metal expansion portion between the body and the second external electrode and directly in contact with the second end portion;

a first connection layer comprising a first plurality of layers between the first metal expansion portion and the first external electrode, each of the first plurality of layers including an intermetallic compound; and a second connection layer comprising a second plurality of layers between the second metal expansion portion and the second external electrode, each of the second plurality of layers including an intermetallic compound.

2. The inductor of claim 1, wherein the first metal expansion portion encloses an exposed surface of the first end portion exposed at the external surface of the body, and the second metal expansion portion encloses an exposed surface of the second end portion exposed at the external surface of the body.

3. The inductor of claim 1, wherein the intermetallic compound included in one of the first plurality of layers is different than the intermetallic compound included in another one of the first plurality of layers, and the intermetallic compound included in one of the second plurality of layers is different than the intermetallic compound included in another one of the second plurality of layers.

4. The inductor of claim 3, wherein the first and second connection layers each include an inner layer close to the first and second metal expansion portions, respectively, and an outer layer close to the first and second external electrodes, respectively.

5. The inductor of claim 4, wherein the inner layer contains a $Cu_6Sn_5$ alloy.

6. The inductor of claim 4, wherein the outer layer contains a $Cu_3Sn$ alloy.

7. The inductor of claim 1, wherein each of the first and second external electrodes includes a plurality of layers, and a first layer in an innermost portion includes a conductive frame and a cured resin filled in the conductive frame.

8. The inductor of claim 7, wherein the conductive frame contains an intermetallic compound of an Ag-Sn based alloy.

9. The inductor of claim 8, wherein the conductive frame has a structure in which Ag particles or Sn-containing solder particles are dispersed in the intermetallic compound.

10. The inductor of claim 7, wherein the cured resin is an epoxy-based resin.

11. The inductor of claim 7, wherein the first and second external electrodes each further include an Sn plating layer in an outermost portions thereof.

12. The inductor of claim 7, wherein the first and second external electrodes each further include an Ni plating layer.

13. The inductor of claim 1, wherein the first and second metal expansion portions each include a Cu plating layer.

14. The inductor of claim 1, wherein the first and second metal expansion portions entirely cover respective external surfaces of the body to which the first and second end portions are exposed.

15. The inductor of claim 1, wherein the first and second metal expansion portions each have an average thickness of 1μm to 20 μm.

16. The inductor of claim 1, wherein an insulating layer is disposed on at least a portion of the external surface of the body.

17. An inductor comprising:

a body, including a coil with an end portion exposed at a side surface of the body with an exposed portion having a first area;

a metal expansion portion on the side surface, in contact with the exposed portion of the end portion of the coil, and covering a second area of the side surface larger than the first area of the end portion;

a first inner layer enclosing and in contact with the metal expansion portion and containing a first intermetallic compound;

a second inner layer enclosing and in contact with the first inner layer and containing a second intermetallic compound; and an external electrode layer enclosing and in contact with the second inner layer.

18. The inductor of claim 17, wherein each of the first inner layer, second inner layer, and external electrode layer is in contact with a thickness surface of the body connected to the end surface.

19. The inductor of claim 17, wherein the metal expansion portion extends from a lower end of the side surface to an upper end of the side surface.

20. The inductor of claim 17, wherein the metal expansion portion contains Cu;

the first inner layer contains a $Cu_6Sn_5$ alloy;

the second inner layer contains a $Cu_3Sn$ alloy; and the external electrode layer includes a first layer in contact with the second inner layer and comprising a conductive frame and a cured resin in the conductive frame.

21. An inductor comprising:

a body, including a coil with an end portion exposed at a side surface of the body;

an external electrode on the side surface of the body and electrically connected to the end portion of the coil, wherein the end portion of the coil is electrically connected to the external electrode through a first layer having a wider cross-sectional area than the end portion, a second layer containing a first intermetallic compound and a third layer containing a second intermetallic compound.

22. The inductor of claim 21, wherein the external electrode includes an inner layer comprising a conductive frame and a cured resin in the conductive frame.

23. The inductor of claim 21, wherein at least one of the first or second intermetallic compound is a Cu-Sn intermetallic compound.

24. The inductor of claim 21, wherein the second intermetallic compound is different from the first intermetallic compound.

* * * * *